US007435522B2

(12) United States Patent
Maniar et al.

(10) Patent No.: US 7,435,522 B2
(45) Date of Patent: Oct. 14, 2008

(54) CARRIER COMPOSITIONS

(75) Inventors: Deepak R. Maniar, Webster, NY (US); Thomas C. Dombroski, Rochester, NY (US); Victor Berko-Boateng, Penfield, NY (US); Christopher M. Pattison, Rochester, NY (US); Angela Schnuerch, Naples, NY (US)

(73) Assignee: Xerox Corporation, Norwalk, CT (US)

( * ) Notice: Subject to any disclaimer, the term of this patent is extended or adjusted under 35 U.S.C. 154(b) by 566 days.

(21) Appl. No.: 11/094,409

(22) Filed: Mar. 31, 2005

(65) Prior Publication Data

US 2006/0222994 A1 Oct. 5, 2006

(51) Int. Cl.
*G03G 9/113* (2006.01)

(52) U.S. Cl. ..... 430/137.13; 430/111.1; 430/111.35

(58) Field of Classification Search ..... 430/111.32, 430/111.33, 111.35, 111.1, 137.13
See application file for complete search history.

(56) References Cited

U.S. PATENT DOCUMENTS 3,590,000 A 6/1971 Palermiti et al.
4,233,387 A 11/1980 Mammino et al.
4,265,990 A 5/1981 Stolka et al.
4,368,970 A 1/1983 Hays
4,394,429 A 7/1983 Hays
4,935,326 A 6/1990 Creatura et al.
4,937,166 A 6/1990 Creatura et al.
5,484,681 A * 1/1996 Cunningham et al. .. 430/137.13
5,512,403 A * 4/1996 Tyagi et al. ..... 430/111.33
5,567,562 A 10/1996 Creatura et al.
5,700,615 A * 12/1997 Silence et al. ..... 430/111.32
6,010,811 A * 1/2000 Baba et al. ..... 430/110.4
6,042,981 A 3/2000 Barbetta et al.
6,143,456 A * 11/2000 Silence et al. ..... 430/111.32

* cited by examiner

*Primary Examiner*—Janis L Dote
(74) *Attorney, Agent, or Firm*—Oliff & Berridge, PLC

(57) ABSTRACT

Coated carrier particles are provided for use in developer compositions for electrophotographic imaging. The coated carrier particles include a carrier core and a resin coating that includes first and second polymer components. The coated carrier particles exhibit stable triboelectric charging during aging, decreased coating hardness, higher coating coverage, and an improved resilience to toner impaction.

5 Claims, 5 Drawing Sheets

CARRIER COMPOSITIONS

BACKGROUND

This disclosure relates generally to improved carrier compositions for use in electrophotographic imaging processes. In particular, this disclosure provides carrier compositions having improved impaction resilience, developer compositions including such improved carrier compositions, and image forming methods using such developer compositions.

The electrophotographic processes, and particularly the xerographic process, are well known. This process involves the formation of an electrostatic latent image on a photoreceptor, followed by development of the image with a developer, and subsequent transfer of the image to a suitable substrate. Numerous different types of xerographic imaging processes are known wherein, for example, insulative developer particles or conductive developer particles are selected depending on the development systems used. Moreover, appropriate triboelectric charging values associated with the aforementioned developer compositions are important, as these values enable continued constant developed images of high quality and excellent resolution.

Carrier particles in part consist of a roughly spherical core, often referred to as the "carrier core," which may be made from a variety of materials. The core is typically coated with a resin. This resin may be made from a polymer or copolymer. The resin may have conductive material or charge enhancing additives incorporated into it to provide the carrier particles with more desirable and consistent triboelectric properties. The resin may be in the form of a powder, which may be used to coat the carrier particle. Often the powder or resin is referred to as the "carrier coating" or "coating."

Various coated carrier particles for use in electrophotographic developers are known in the art. Carrier particles for use in the development of electrostatic latent images are described in many patents including, for example, U.S. Pat. No. 3,590,000, the disclosure of which is incorporated by reference herein in its entirety. These carrier particles may consist of various cores, including steel, with a coating thereover of fluoro-polymers and ter-polymers of styrene, methacrylate, and silane compounds.

U.S. Pat. No. 4,233,387, the disclosure of which is incorporated by reference herein in its entirety, illustrates coated carrier components for electrophotographic developer mixtures comprised of finely divided toner particles clinging to the surface of the carrier particles. Specifically, U.S. Pat. No. 4,233,387 discloses coated carrier particles obtained by mixing carrier core particles of an average diameter of from about 30 microns to about 1,000 microns, with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 450° F. for a period of 20 minutes to about 60 minutes, enabling the thermoplastic resin particles to melt and fuse on the carrier core. While these developer and carrier particles are suitable for their intended purposes, the conductivity values of the resulting particles are not constant in all instances, for example, when a change in carrier coating weight is accomplished to achieve a modification of the triboelectric charging characteristics. Further, only specific triboelectric charging values can be generated, when certain conductivity values or characteristics are contemplated.

U.S. Pat. No. 4,937,166, the disclosure of which is incorporated by reference herein in its entirety, describes a carrier composition comprised of a core with a coating thereover comprised of a mixture of first and second polymers that are not in close proximity thereto in the triboelectric series. The core is described to be iron, ferrites, steel or nickel. The first and second polymers are selected from the group consisting of polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and polystyrene; and polyvinyl acetate and polymethyl methacrylate. The particles are described to have a triboelectric charging value of from about −5 to about −90 microcoulombs per gram.

U.S. Pat. No. 4,935,326, the disclosure of which is incorporated by reference herein in its entirety, discloses a carrier and developer composition, and a process for the preparation of carrier particles with substantially stable conductivity parameters, which comprises (1) providing carrier cores and a polymer mixture; (2) dry mixing the cores and the polymer mixture; (3) heating the carrier core particles and polymer mixture, whereby the polymer mixture melts and fuses to the carrier core particles; and (4) thereafter cooling the resulting coated carrier particles. These particulate carriers for electrophotographic toners are described to be comprised of core particles with a coating thereover comprised of a fused film of a mixture of first and second polymers which are not in close proximity in the triboelectric series, the mixture being selected from the group consisting of polyvinylidenefluoride and polyethylene; polymethyl methacrylate and copolyethylene vinyl acetate; copolyvinylidenefluoride tetrafluoroethylene and polyethylenes; copolyvinylidenefluoride tetrafluoroethylene and copolyethylene vinyl acetate; and polymethyl methacrylate and polyvinylidenefluoride.

U.S. Pat. No. 5,567,562, the disclosure of which is incorporated by reference herein in its entirety, describes a process for the preparation of conductive carrier particles which comprises mixing a carrier core with a first polymer pair and a second polymer pair, heating the mixture, and cooling the mixture, wherein the first and second polymer pair each contain an insulating polymer and a conductive polymer and wherein the carrier conductivity thereof is from about $10^{-6}$ to about $10^{-14}$ (ohm-cm)$^{-1}$. The first polymer pair is preferably comprised of an insulating polymethyl methacrylate and a conductive polymethyl methacrylate, and the second polymer pair is preferably comprised of an insulating polyvinylidenefluoride and a conductive polyvinylidenefluoride.

U.S. Pat. No. 6,042,981, the disclosure of which is incorporated by reference herein in its entirety, discloses carriers including a polymer coating wherein the polymer coating may contain a conductive component, such as carbon black, and which conductive component, is preferably dispersed in the polymer coating. The conductive component is incorporated into the polymer coating of the carrier core by combining the carrier core, polymer coating, and the conductive component in a mixing process such as cascade roll mixing, tumbling, milling, shaking, electrostatic powder cloud spraying, fluidized bed, electrostatic disc processing or by an electrostatic curtain. After the mixing process, heating is initiated to coat the carrier core with the polymer coating and conductive component.

Efforts to advance carrier particle science have largely focused on the attainment of coatings for carrier particles to improve development quality and provide particles that can be recycled and that do not adversely affect the imaging member in any substantial manner. Many of the present commercial coatings can deteriorate rapidly, especially when selected for a continuous xerographic process where the entire coating may separate from the carrier core in the form of chips or flakes causing failure upon impact or abrasive contact with machine parts and other carrier particles. These flakes or chips, which cannot generally be reclaimed from the developer mixture, have an adverse effect on the triboelectric charging characteristics of the carrier particles, thereby providing images with lower resolution in comparison to those compositions wherein the carrier coatings are retained on the surface of the core substrate.

Further, another problem encountered with some prior art carrier coatings resides in fluctuating triboelectric charging characteristics, particularly with changes in relative humidity. High relative humidity hinders image density in the xerographic process, may cause background deposits, leads to developer instability, and may result in an overall degeneration of print quality. Triboelectric charges are usually lower under high temperature, high humidity conditions than under low temperature, low humidity conditions. It is desirable to have the measured triboelectric charges (tc) for a particular carrier used under high temperature, high humidity conditions and under low temperature, low humidity conditions, when entered into a ratio of (high temperature and high humidity)$_{tc}$/(low temperature and low humidity)$_{tc}$, to be close to 1.0 in order to obtain good development in high humidity.

In addition, mechanical stresses on developer compositions, including the carrier particles therein, remain problematic. Successive linear piles of developer material move along the exterior of the developer sleeve. As a result, the skiving blade periodically impacts the entire length of a linear pile of developer material, and there is a periodic and substantial increase in mechanical stress on the developer material, due to the rapid succession of developer pile masses encountered by the edge of the skiving blade. During each stress peak, the skiving blade, magnetic developer roll, developer material, along with the motor drive and any respective mechanisms including motor drive bearings, will experience a significant increase in mechanical force. Such skiving action can also include vibration between both the skiving blade and the shell, with resulting impact to the carrier particles, which shortens developer material life. For example, with respect to developer material containing carrier particles each of which are formed of a carrier core and a coating, the entire coating may separate from the carrier core as fragments in the form of chips or flakes, or the particles may fracture or otherwise fail upon impact, with subsequent sub-particles experiencing abrasive contact with machine parts and other carrier particles. These fragments, which generally cannot be reclaimed from the developer mixture, have an adverse effect on the triboelectric charging characteristics of the carrier particles, thereby yielding images with lower resolution in comparison to those compositions wherein the carrier coatings are retained on the surface of the core substrate.

As described above, there is a continuing need for carrier compositions having resilient coatings, and for developer compositions containing such carrier particles.

SUMMARY

Carrier compositions comprising cores and resilient coating layers are provided. Methods of preparing such carrier compositions are also provided.

In embodiments, coated carrier particles described herein incorporate a coating that is sufficiently resilient so as to maintain the encapsulation of the carrier core while withstanding the mechanical action that would otherwise cause fragmentation of the carrier particles. The carrier particles according to this disclosure have a "sufficiently resilient" coating when the coating is sufficient to maintain encapsulation of the carrier core, or fragments thereof, even after being subject to the mechanical action of the developer material stripping device, thus substantially preventing dispersion of carrier core fragments in the event of such fracturing or fragmentation of the carrier core.

Separately provided are developer compositions containing carrier compositions that comprise cores and resilient coating layers.

Image forming apparatuses are separately provided, in which developer compositions contain carrier compositions that comprise cores and resilient coating layers.

These and other features and advantages of various exemplary embodiments of materials, devices, systems and/or methods are described in or are apparent from, the following detailed description.

BRIEF DESCRIPTION OF THE DRAWINGS

Preferred embodiments will be described in detail below with reference to drawings in some cases. In the drawings, the same reference numerals and signs are used to designate the same or corresponding parts, and repeated descriptions are avoided.

DETAILED DESCRIPTION OF EMBODIMENTS

Carrier Compositions

Figure 1:
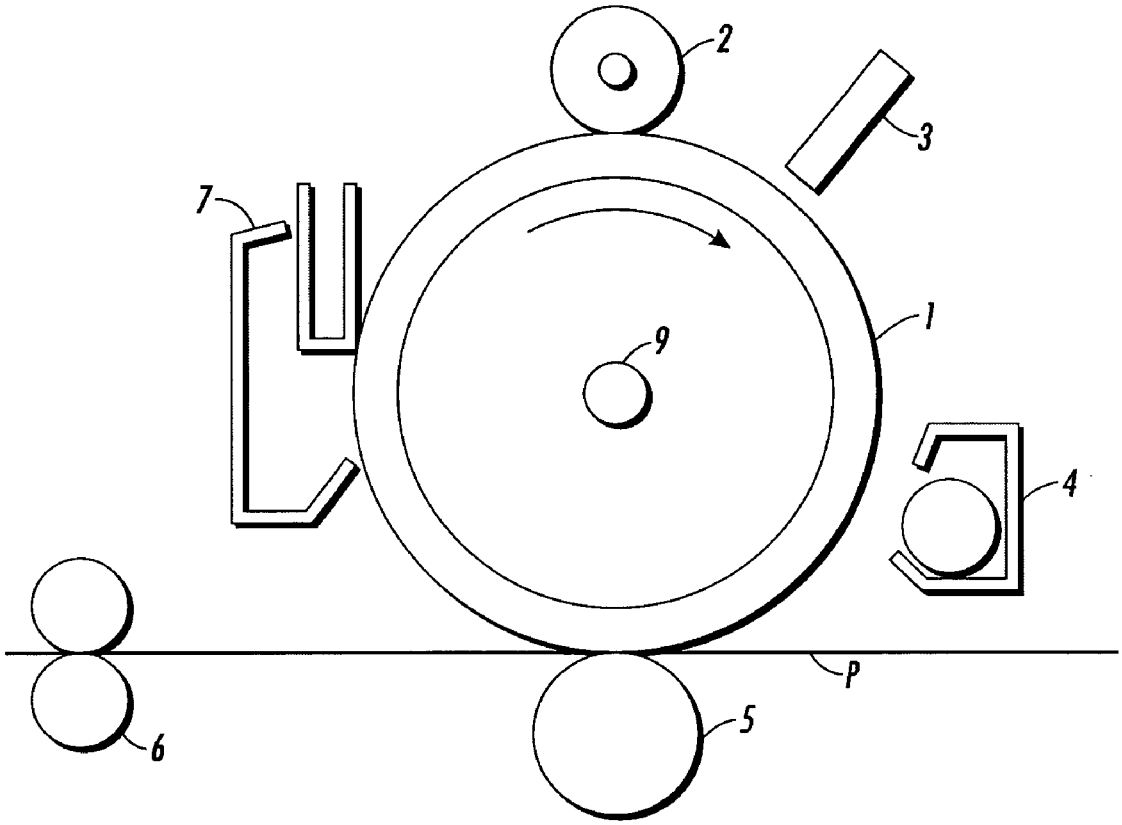
FIG. 1 is a schematic view showing an embodiment of an image forming apparatus.

The carrier compositions of this disclosure comprise core particles coated thereover with a mixture of at least a first polymer component and a second polymer component.

As the core particle, various suitable solid core carrier materials may be selected. The core preferably should possess properties that will enable toner particles to acquire a positive charge or a negative charge, and that will permit desirable flow properties in the developer reservoir present in the xerographic imaging apparatus. The core should also preferably possess desirable mechanical aging characteristics.

Examples of carrier cores that may be selected include iron, steel, ferrites, magnetites, nickel, and mixtures thereof. The carrier cores of some preferred embodiments are magnetite. The core particles preferably have an average particle diameter of from about 50 to about 80 microns, more preferably about 60 to about 70 microns, most preferably about 65 microns as determined by standard laser diffraction techniques.

The carrier cores are coated with a powder mixture of at least a first polymer component and a second polymer component. The first and second polymer components are initially provided as polymer powders.

The first polymer component may be chosen from polymers and copolymers of acrylates and methacrylates. In particular, polymers and copolymers of alkyl acrylates and alkyl methacrylates may be chosen as polymer powders for the coating composition. In particular, the first polymer is preferably comprised of a polymer or copolymer of polymethyl methacrylate (PMMA). The acrylates and methacrylates may be copolymerized with any desired comonomer, so long as the resulting copolymer retains a suitable particle size. Suitable comonomers can include monoalkyl, or dialkyl amines, such as dimethylaminoethyl methacrylate, diethylaminoethyl methacrylate, and the like.

The second polymer component may be chosen from thermoplastic resin copolymers, terpolymers and polymers, which contain at least a styrene-based monomer unit and a rubber monomer unit, hydrogenated styrenic block copolymers, hydrogenated poly-isoprene copolymers, hydrogenated polyisoprene/butadiene copolymers or hydrogenated polybutadiene polymers. Non-hydrogenated grades of the aforementioned polymer structures can be also used as second polymer component. Preferably, the second polymer component is a copolymer. In preferred embodiments, the second polymer component is a diblock or triblock copolymer, such as A-B or A-B-A, but random copolymers can also be used. The styrene block may be present in amounts of from about 2 percent to about 95 percent by weight. The rubber block may be present in amounts of from about 95 percent to about 2 percent by weight. In particular, suitable thermoplastic resins include, but are not limited to linear triblock copolymers, such as styrene-butadiene-styrene, styrene-isoprene-styrene, styrene-ethylene-butylene-styrene copolymers; blended diblock polymers, such as styrene-ethylene-propylene copolymers, styrene-ethylene-butylene copolymers, hydrogenated polyisoprenes, hydrogenated polyisoprene/butadiene and hydrogenated polybutadiene polymers, hydrogenated styrenic block copolymers. Non-hydrogenated grades of the aforementioned polymer structures can also be used as second polymer component. Such thermoplastic resins are commercially available, under the KRATON trademark of Kraton Chemical Company and under the SEPTON trademark of Septon Company of America.

The first polymer component and the second polymer component, and any additional optional components, are dry mixed to form a carrier coating powder mixture.

The percentage of each polymer component present in the carrier coating mixture can vary depending on the specific components selected, the coating weight and the properties desired. Generally, the coated polymer mixtures used contain from about 99 to about 1 percent of the first polymer component, and from about 1 to about 99 percent by weight of the second polymer component, based on the total weight of the polymeric coating. Preferably, the mixture of powdered polymer components comprises from about 10 to 95 percent by weight of the first polymer component, and from about 5 to 90 percent by weight of the second polymer component. Still more preferably, the mixture of powdered polymer components comprises from about 50 to 95 percent by weight of the first polymer component, and from about 5 to 50 percent by weight of the second polymer component. Most preferably, the mixture of powdered polymer components comprises from about 95 to 90 percent by weight of the first polymer component, and from about 5 to 10 percent by weight of the second polymer component.

The carrier particles may be prepared by mixing the carrier core with any suitable amount of coating powder mixtures, such as from, for example, between about 0.05 to about 10 percent by weight, more preferably between about 0.05 percent and about 3 percent by weight, based on the weight of the coated carrier particles, of the carrier coating powder mixture until adherence thereof to the carrier core by mechanical impaction and/or electrostatic attraction. The mixture of carrier core particles and polymers is then heated to a temperature of, for example, between from about 200° F. to about 650° F., preferably about 320° F. to about 550° F., most preferably about 430° F. to about 460° F., for a period of time of from, for example, about 10 minutes to about 60 minutes, enabling the polymers to melt and fuse to the carrier core particles. The coated carrier particles are then cooled and thereafter classified to a desired particle size. The coating preferably has a coating weight of from, for example, about 0.1-3.0 percent by weight of the carrier, preferably about 0.1-1.2 percent by weight.

Various effective suitable means can be used to apply the polymer mixture coatings to the surface of the carrier core particles. Non-limiting examples of application means include combining the carrier core material and the mixture of polymers by cascade roll mixing, or tumbling, milling, shaking, electrostatic powder cloud spraying, fluidized bed, electrostatic disc processing, and an electrostatic curtain. Following application of the polymer mixture, heating is initiated to permit flow of the coating material over the surface of the carrier core. The concentration of the coating material powder particles, as well as the parameters of the heating step, may be selected to enable the formation of a preferably continuous film of the coating material on the surface of the carrier core, or permit only selected areas of the carrier core to be coated. When selected areas of the carrier core remain uncoated or exposed, the carrier particles will possess electrically conductive properties when the core material comprises a metal.

Developer Compositions

In electrophotographic imaging, developer compositions may comprise one or more toner compositions and one or more carrier compositions. Developers incorporating the coated carriers described herein can be generated by mixing the carrier core particles with a toner composition comprised of resin particles and pigment particles. Generally, from about 1 part to about 5 parts by weight of toner particles are mixed with from about 10 to about 300 parts by weight of the carrier particles.

The toner concentration in the developer initially installed in a xerographic development housing is between 3.5 and 5 parts of toner per one hundred parts of carrier. Over the life of the developer, this concentration can vary from 3.5 to 9.0 parts of toner per one hundred parts of carrier with no significant impact on the copy quality of the resulting images. The developer composition preferably has a breakdown voltage of 200-1300 V, more preferably about 1000 V.

Toner compositions that may be used in accordance with embodiments are not particularly limited and should be readily understood by those of skill in the art. Illustrative examples of suitable toner resins for use in embodiments of the developer compositions include polyamides, epoxies, polyurethanes, diolefins, vinyl resins, styrene acrylates, styrene methacrylates, styrene butadienes, polyesters such as the polymeric esterification products of a dicarboxylic acid and a diol comprising a diphenol, cross linked polyesters, and the like. Specific vinyl monomers include styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate;

vinyl esters like the esters of monocarboxylic acids including methyl acrylate, ethyl acrylate, n-butyl-acrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl indole, N-vinyl pyrrolidone; and the like. Also, there may be selected styrene butadiene copolymers, mixtures thereof, and the like.

Numerous well known suitable pigments or dyes can be selected as the colorant for the toner particles including, for example, carbon black like REGAL 330, nigrosine dye, lamp black, iron oxides, magnetites, colored magnetites other than black, and mixtures thereof. The pigment, which is preferably carbon black, should be present in a sufficient amount to render the toner composition highly colored. Thus, the pigment particles can be present in amounts of from about 3 percent by weight to about 20 and preferably from 5 to about 15 percent by weight, based on the total weight of the toner composition, however, lesser or greater amounts of pigment particles may be selected in embodiments.

The resin particles are present in a sufficient, but effective amount, thus when 10 percent by weight of pigment, or colorant such as carbon black is contained therein, about 90 percent by weight of resin material is selected. Generally, however, the toner composition is comprised of from about 85 percent to about 97 percent by weight of toner resin particles, and from about 3 percent by weight to about 15 percent by weight of pigment particles such as carbon black.

Additional embodiments include colored toner and developer compositions comprising of toner resin particles, carrier particles, and as pigments or colorants, red, green, brown, blue, magenta, cyan and/or yellow particles, as well as mixtures thereof. More specifically, illustrative examples of magenta materials that may be selected as pigments include 1,9-dimethyl-substituted quinacridone and anthraquinone dye identified in the color index as CI 60720, CI Dispersed Red 15, a diazo dye identified in the color index as CI 26050, CI Solvent Red 19, and the like. Examples of cyan materials that may be used as pigments include copper tetra-4(octaecyl sulfonamido) phthalocyanine, X-copper phthalocyanine pigment listed in the color index as CI 74160, CI Pigment Blue, and Anthrathrene Blue, identified in the color index as CI 69810, Special Blue X-2137, and the like; while illustrative examples of yellow pigments that may be selected are diarylide yellow 3,3-dichlorobenzidene acetoacetanilides, a monoazo pigment identified in the color index as CI 12700, CI Solvent Yellow 16, a nitrophenyl amine sulfonamide identified in the color index as Foron Yellow SE/GLN, CI Dispersed Yellow 33, 2,5-dimethoxy-4-sulfonanilide phenylazo-4'-chloro-2,5-dimethoxy acetoacetanilide, permanent yellow FGL, and the like. These pigments are generally present in the toner composition in an amount of from about 1 weight percent to about 15 weight percent based on the weight of the toner resin particles.

For enhancing the charging characteristics of the developer compositions described herein, and as optional components there can be incorporated into the toner or on its surface charge enhancing additives inclusive of alkyl pyridinium halides, such as those disclosed in U.S. Pat. No. 4,298,672 (the disclosure of which is incorporated herein by reference in its entirety); organic sulfate or sulfonate compositions, such as those disclosed in U.S. Pat. No. 4,338,390 (the disclosure of which is incorporated herein by reference in its entirety); distearyl dimethyl ammonium sulfate; bisulfates, and the like and other similar known charge enhancing additives; as well as aluminum complexes, like BONTRON E-88, and the like. These additives are usually incorporated into the toner in an amount of from about 0.1 percent by weight to about 20 percent by weight, and preferably from 1 to about 3 percent by weight.

The toner composition of embodiments can be prepared by a number of known methods including melt blending the toner resin particles, and pigment particles or colorants followed by mechanical attrition. Other methods include those well known in the art such as spray drying, melt dispersion, dispersion polymerization, suspension polymerization, and extrusion. In one dispersion polymerization method, a solvent dispersion of the resin particles and the pigment particles is spray dried under controlled conditions to result in the desired product. Generally, the toners are prepared by mixing, followed by attrition, and classification to enable toner particles with an average volume diameter of from about 5 to about 20 microns.

Also, the toner and developer compositions of embodiments may be selected for use in electrophotographic imaging processes containing conventional photoreceptors, including inorganic and organic photoreceptor imaging members. Examples of imaging members are selenium, selenium alloys, and selenium or selenium alloys containing therein additives or dopants such as halogens. Furthermore, organic photoreceptors, illustrative examples of which include layered photoresponsive devices comprised of transport layers and photogenerating layers, such as those disclosed in U.S. Pat. No. 4,265,990 (the disclosure of which is incorporated herein by reference in its entirety), and other similar layered photoresponsive devices may be used in embodiments. Examples of generating layers are trigonal selenium, metal phthalocyanines, metal free phthalocyanines and vanadyl phthalocyanines. As charge transport molecules there can be selected the aryl diamines disclosed in U.S. Pat. No. 4,265,990. Also, there can be selected as photogenerating pigments squaraine compounds, thiapyrillium materials, and the like. These layered members are conventionally charged negatively thus requiring a positively charged toner. Moreover, the developer compositions of embodiments are particularly useful in electrophotographic imaging processes and apparatuses in which there are moving transporting means and moving charging means; and in which there is a deflected flexible layered imaging member, such as disclosed in U.S. Pat. Nos. 4,394,429 and 4,368,970, the disclosures of which are incorporated herein by reference in their entirety.

Images obtained with the developers composition disclosed herein exhibit acceptable solids, excellent halftones and desirable line resolution with acceptable or substantially no background deposits.

The carrier compositions disclosed are thus ideally suited for use in electrophotographic printing operations, in particular electrophotographic printing operations using a magnetic brush development system to develop a latent image formed on a photoreceptor.

Carrier compositions such as those described above provide distinct advantages in applications involving low area coverage printing. In particular, the lower hardness and rubbery nature of the coating of these carrier compositions, relative to conventional carrier compositions, result in decreased impaction of toner and other additives on the carrier surface, providing greater triboelectric stability and improved aging properties.

Image Forming Apparatus

FIG. 1 is a schematic view showing an embodiment of an image forming apparatus. In the apparatus shown in FIG. 1, an electrophotographic photoreceptor 1 is supported by a support 9, and rotatable at a specified rotational speed in the direction indicated by the arrow, centered on the support 9. A contact charging device 2, an exposure device 3, a developing device 4, a transfer device 5 and a cleaning unit 7 are arranged in this order along the rotational direction of the electrophotographic photoreceptor 1. Further, this exemplary apparatus is equipped with an image fixing device 6, and a medium P to which a toner image is to be transferred is conveyed to the image fixing device 6 through the transfer device 5.

The contact charging device 2 has a roller-shaped contact charging member. The contact charging member is arranged so that it comes into contact with a surface of the photoreceptor 1, and a voltage is applied, thereby being able to give a specified potential to the surface of the photoreceptor 1. In embodiments, a contact charging member may be formed from a metal such as aluminum, iron or copper, a conductive polymer material such as a polyacetylene, a polypyrrole or a polythiophene, or a dispersion of fine particles of carbon black, copper iodide, silver iodide, zinc sulfide, silicon carbide, a metal oxide or the like in an elastomer material such as polyurethane rubber, silicone rubber, epichlorohydrin rubber, ethylene-propylene rubber, acrylic rubber, fluororubber, styrene-butadiene rubber or butadiene rubber. Non-limiting examples of metal oxides that may be used in embodiments include ZnO, $SnO_2$, $TiO_2$, $In_2O_3$, $MoO_3$ and complex oxides thereof. Further, a perchlorate may be added to the elastomer material to impart conductivity.

Further, a covering layer can also be provided on a surface of the contact charging member of embodiments. Non-limiting examples of materials that may be used in embodiments for forming a covering layer include N-alkoxy-methylated nylon, cellulose resins, vinylpyridine resins, phenol resins, polyurethanes, polyvinyl butyrals, melamines and mixtures thereof. Furthermore, emulsion resin materials such as acrylic resin emulsions, polyester resin emulsions or polyurethanes, may be used. In order to further adjust resistivity, conductive agent particles may be dispersed in these resins, and in order to prevent deterioration, an antioxidant can also be added thereto. Further, in order to improve film forming properties in forming the covering layer, a leveling agent or a surfactant may be added to the emulsion resin in embodiments.

The resistance of the contact charging member of embodiments may be from $10^0$ to $10^{14}$ Ωcm, and from $10^2$ to $10^{12}$ Ωcm. When a voltage is applied to this contact charging member, either a DC voltage or an AC voltage can be used as the applied voltage. Further, a superimposed voltage of a DC voltage and an AC voltage can also be used.

In the exemplary apparatus shown in FIG. 1, the contact charging member of the contact charging device 2 is in the shape of a roller. However, such a contact charging member may be in the shape of a blade, a belt, a brush or the like.

Further, in embodiments an optical device that can perform desired imagewise exposure to a surface of the electrophotographic photoreceptor 1 with a light source such as a semiconductor laser, an LED (light emitting diode) or a liquid crystal shutter, may be used as the exposure device 3.

Furthermore, a known developing device using a normal or reversal developing agent of a one-component system, a two-component system or the like may be used in embodiments as the developing device 4. There is no particular limitation on toners that may be used in embodiments.

Contact type transfer charging devices using a belt, a roller, a film, a rubber blade or the like, or a scorotron transfer charger or a corotron transfer charger utilizing corona discharge may be employed as the transfer device 5, in various embodiments.

Further, in embodiments, the cleaning device 7 may be a device for removing a remaining toner adhered to the surface of the electrophotographic photoreceptor 1 after a transfer step, and the electrophotographic photoreceptor 1 repeatedly subjected to the above-mentioned image formation process may be cleaned thereby. In embodiments, the cleaning device 7 may be a cleaning blade, a cleaning brush, a cleaning roll or the like. Materials for the cleaning blade include urethane rubber, neoprene rubber and silicone rubber.

In the exemplary image forming device shown in FIG. 1, the respective steps of charging, exposure, development, transfer and cleaning are conducted in turn in the rotation step of the electrophotographic photoreceptor 1, thereby repeatedly performing image formation. The electrophotographic photoreceptor 1 may be provided with specified silicon-containing layers and photosensitive layers that satisfy equation (1), as described above, and thus photoreceptors having excellent discharge gas resistance, mechanical strength, scratch resistance, particle dispersibility, etc., may be provided. Accordingly, even in embodiments in which the photoreceptor is used together with the contact charging device or the cleaning blade, or further with spherical toner obtained by chemical polymerization, good image quality can be obtained without the occurrence of image defects such as fogging. That is, embodiments provide image forming apparatuses that can stably provide good image quality for a long period of time is realized.

Figure 2:
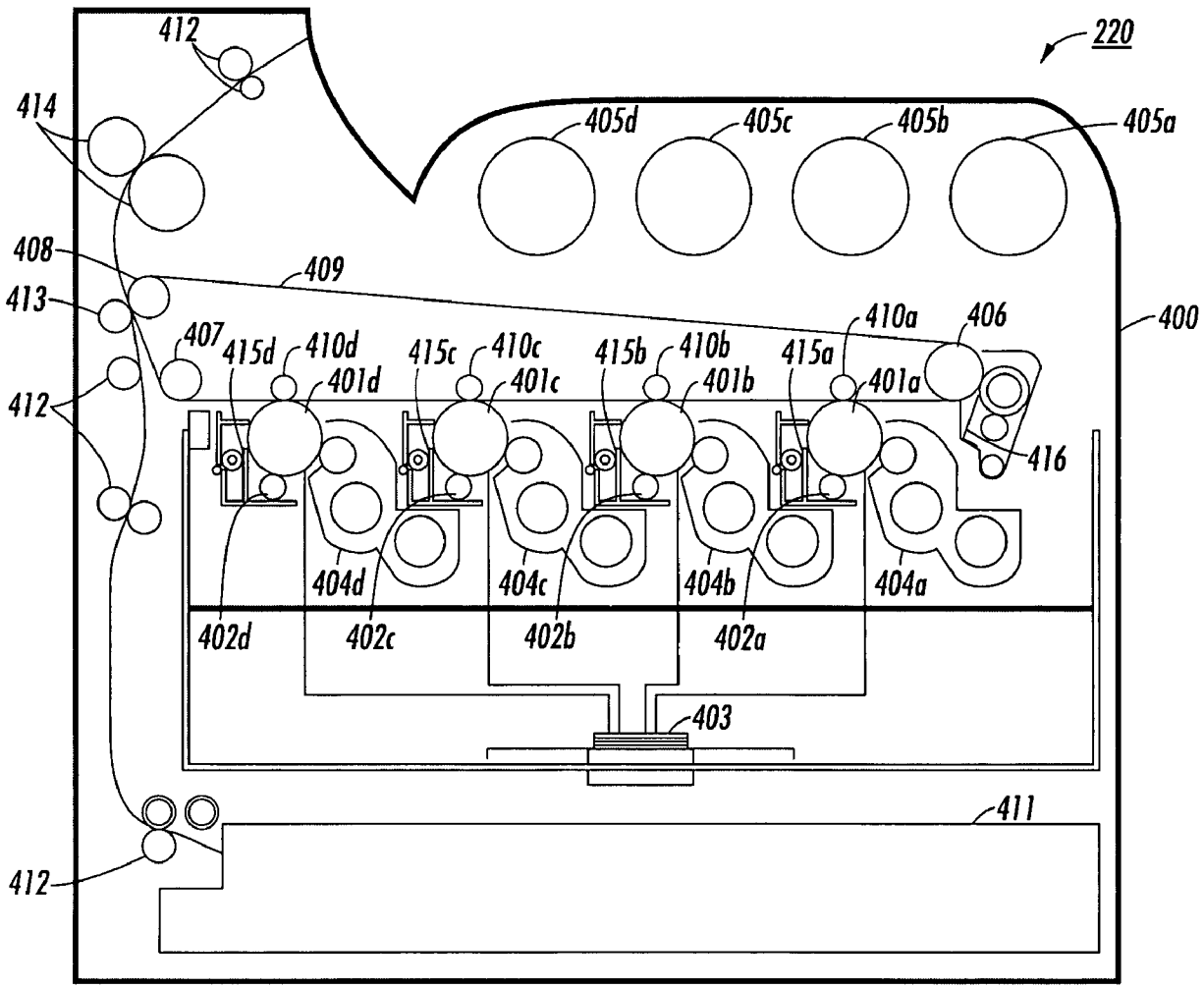
FIG. 2 is a schematic view showing another embodiment of an image forming apparatus.

FIG. 2 is a cross sectional view showing another exemplary embodiment of an image forming apparatus. The image forming apparatus 220 shown in FIG. 2 is an image forming apparatus of an intermediate transfer system, and four electrophotographic photoreceptors 401*a* to 401*d* are arranged in parallel with each other along an intermediate transfer belt 409 in a housing 400.

Here, the electrophotographic photoreceptors 401*a* to 401*d* carried by the image forming apparatus 220 are each the electrophotographic photoreceptors of embodiments. Each of the electrophotographic photoreceptors 401*a* to 401*d* may rotate in a predetermined direction (counterclockwise on the sheet of FIG. 2), and charging rolls 402*a* to 402*d*, developing device 404*a* to 404*d*, primary transfer rolls 410*a* to 410*d* and cleaning blades 415*a* to 415*d* are each arranged along the rotational direction thereof. In each of the developing device 404*a* to 404*d*, four-color toners of yellow (Y), magenta (M), cyan (C) and black (B) contained in toner cartridges 405*a* to 405*d* can be supplied, and the primary transfer rolls 410*a* to 410*d* are each brought into abutting contact with the electrophotographic photoreceptors 401*a* to 401*d* through an intermediate transfer belt 409.

Further, a laser light source (exposure unit) 403 is arranged at a specified position in the housing 400, and it is possible to irradiate surfaces of the electrophotographic photoreceptors 401*a* to 401*d* after charging with laser light emitted from the laser light source 403. This performs the respective steps of charging, exposure, development, primary transfer and cleaning in turn in the rotation step of the electrophotographic photoreceptors 401*a* to 401*d*, and toner images of the respective colors are transferred onto the intermediate transfer belt 409, one over the other.

The intermediate transfer belt 409 is supported with a driving roll 406, a backup roll 408 and a tension roll 407 at a specified tension, and rotatable by the rotation of these rolls without the occurrence of deflection. Further, a secondary transfer roll 413 is arranged so that it is brought into abutting contact with the backup roll 408 through the intermediate transfer belt 409. The intermediate transfer belt 409, which has passed between the backup roll 408 and the secondary transfer roll 413, is cleaned up by a cleaning blade 416, and then repeatedly subjected to the subsequent image formation process.

Further, a tray 411, for providing a medium such as paper to which a toner image is to be transferred, is provided at a specified position in the housing 400. The medium to which the toner image is to be transferred in the tray 411 is conveyed in turn between the intermediate transfer belt 409 and the secondary transfer roll 413, and further between two fixing rolls 414 brought into abutting contact with each other, with a conveying roll 412, and then delivered out of the housing 400.

According to the exemplary image forming apparatus 220 shown in FIG. 2, the use of electrophotographic photoreceptors of embodiments as electrophotographic photoreceptors 401*a* to 401*d* may achieve discharge gas resistance, mechanical strength, scratch resistance, etc. on a sufficiently high level in the image formation process of each of the electrophotographic photoreceptors 401*a* to 401*d*. Accordingly, even when the photoreceptors are used together with the contact charging devices or the cleaning blades, or further with the spherical toner obtained by chemical polymerization, good image quality can be obtained without the occurrence of image defects such as fogging. Therefore, also according to the image forming apparatus for color image formation using the intermediate transfer body, such as this embodiment, the image forming apparatus, which can stably provide good image quality for a long period of time, is realized.

The above-mentioned embodiments should not be construed as limiting. For example, each apparatus shown in FIG. 1 or 2 may be equipped with a process cartridge comprising the electrophotographic photoreceptor 1 (or the electrophotographic photoreceptors 401*a* to 401*d*) and charging device 2 (or the charging devices 402*a* to 402*d*). The use of such a process cartridge allows maintenance to be performed more simply and easily.

Further, in embodiments, when a charging device of the non-contact charging system such as a corotron charger is used in place of the contact charging device 2 (or the contact charging devices 402*a* to 402*d*), sufficiently good image quality can be obtained.

Furthermore, in the embodiment of an apparatus that is shown in FIG. 1, a toner image formed on the surface of the electrophotographic photoreceptor 1 is directly transferred to the medium P to which the toner image is to be transferred. However, the image forming apparatus of embodiments may be further provided with an intermediate transfer body. This makes it possible to transfer the toner image from the intermediate transfer body to the medium P to which the toner image is to be transferred, after the toner image on the surface of the electrophotographic photoreceptor 1 has been transferred to the intermediate transfer body. As such an intermediate transfer body, there can be used one having a structure in which an elastic layer containing a rubber, an elastomer, a resin or the like and at least one covering layer are laminated on a conductive support.

In addition, the image forming apparatus of embodiments may be further equipped with a static eliminator such as an erase light irradiation device. This may prevent incorporation of residual potential into subsequent cycles when the electrophotographic photoreceptor is used repeatedly. Accordingly, image quality can be more improved.

EXAMPLES

The embodiments as discussed above are illustrated in greater detail with reference to the following Comparative Example and Examples, but should not be construed as being limited thereto. In the following Examples and Comparative Examples, all the "parts" are given by weight, unless otherwise indicated.

Comparative Example 1

Preparation of a Coated Carrier Composition

In a blender, 45.4 g of a polymethylmethacrylate resin powder (SOKEN available from Soken Chemical of Japan) and 4540 g of a 80 μm steel powder (available from Hoeganaes as ANCOR Steel Powder) are dry mixed in a ratio of 1.00 wt % resin powder to 99.00 wt % 80 μm steel powder. This mixture is fused in a rotary kiln at 450° F. to create a control carrier composition. The triboelectric charging properties, breakdown voltage and conductivity of the carrier composition of Comparative Example 1 were analyzed and the results are summarized below at Table 1.

Example 1

Preparation of a Coated Carrier Composition

In a blender, 40.86 g of a polymethylmethacrylate resin powder (SOKEN available from Soken Chemical of Japan) and 4.54 g of a hydrogenated polyisoprene-butadiene copolymer resin powder (SEPTON 4033, available from Septon Company of America), a weight ratio of 90 parts PMMA to 10 parts hydrogenated polyisoprene-butadiene copolymer resin powder are dry mixed. The resin powder mixture is added to a 80 μm steel powder (available from Hoeganaes as ANCOR Steel Powder) in a weight ratio of 1.00 parts resin powder to 99.00 parts steel powder, and the combined resin powder and steel powder are dry mixed in a Littleford M5R Mixer. This mixture is fused in a laboratory-scale rotary kiln at 450° F. for about 30 minutes, with no throughput, to create a carrier composition. The triboelectric charging properties, breakdown voltage and conductivity of the carrier composition of Example 1 were analyzed and the results are summarized below at Table 1.

Example 2

Preparation of a Coated Carrier Composition

A coated carrier composition is prepared in the same manner as Example 1, except that the coating composition is changed. In particular, 95 parts by weight of PMMA to 5 parts by weight of a hydrogenated polyisoprene-butadiene copolymer resin powder (SEPTON 4033) are dry mixed to form the resin powder mixture for the coating. The triboelectric charging properties, breakdown voltage and conductivity of the carrier composition of Example 2 were analyzed and the results are summarized below at Table 1.

Example 3

Preparation of a Coated Carrier Composition

A coated carrier composition is prepared in the same manner as Example 1, except that the coating composition is prepared on a larger scale. In particular, 40.8 g of PMMA and 4.54 g of a hydrogenated polyisoprene-butadiene copolymer resin powder (SEPTON 4033) are dry mixed to form the resin powder mixture for the coating. The triboelectric charging properties, breakdown voltage and conductivity of the carrier composition of Example 3 were analyzed and the results are summarized below at Table 1.

TABLE 1

| | Coating Weight (Wt %) | Thermoplastic resin (Wt %) | Triboelectric charging (μC/g) | Triboelectric charging % | 30 V Conductivity | Breakdown Voltage |
|---|---|---|---|---|---|---|
| Comparative Example 1 | 1.00 | 0 | 39.24 | 4.16 | 1.66E−10 | 108.6 |
| Example 1 | 1.00 | 10 | 36.37 | 4.32 | 2.06E−14 | 181.4 |
| Example 2 | 1.00 | 5 | 39.34 | 4.23 | 5.64E−11 | 132.6 |
| Example 3 | 1.00 | 10 | 29.10 | 4.18 | 1.41E−08 | 105.6 |

These results show that the carriers of Examples 1 and 2 have triboelectric charging characteristics that are equal to those of the control, Comparative Example 1, but are slightly less conductive. The coated carrier of Example 3, which was produced on a larger scale, is more conductive and triboelectric charging decreases.

Figure 3:
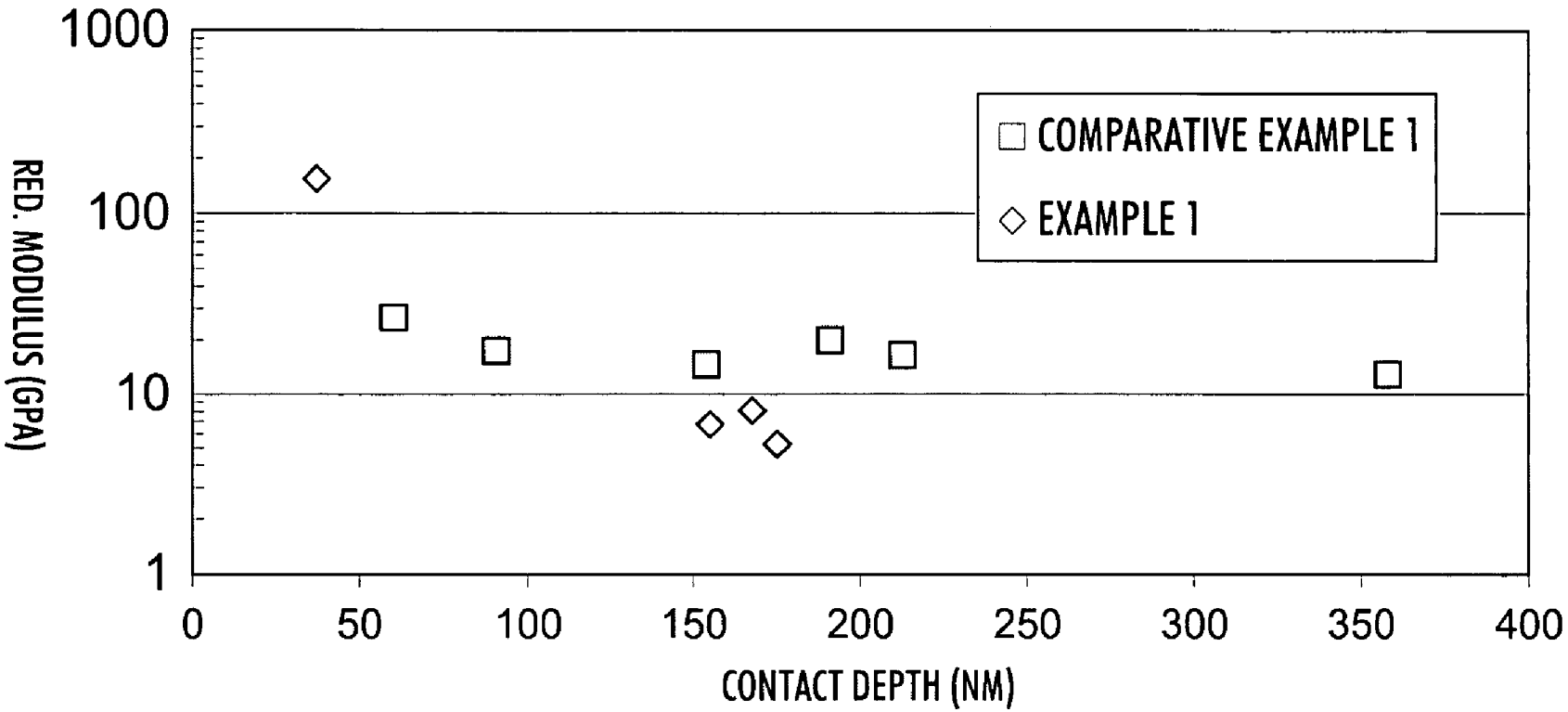
FIG. 3 is a graphical representation of a relationship between contact depth and Red. modulus of an exemplary carrier composition according to embodiments and a conventional carrier composition.
Figure 4:
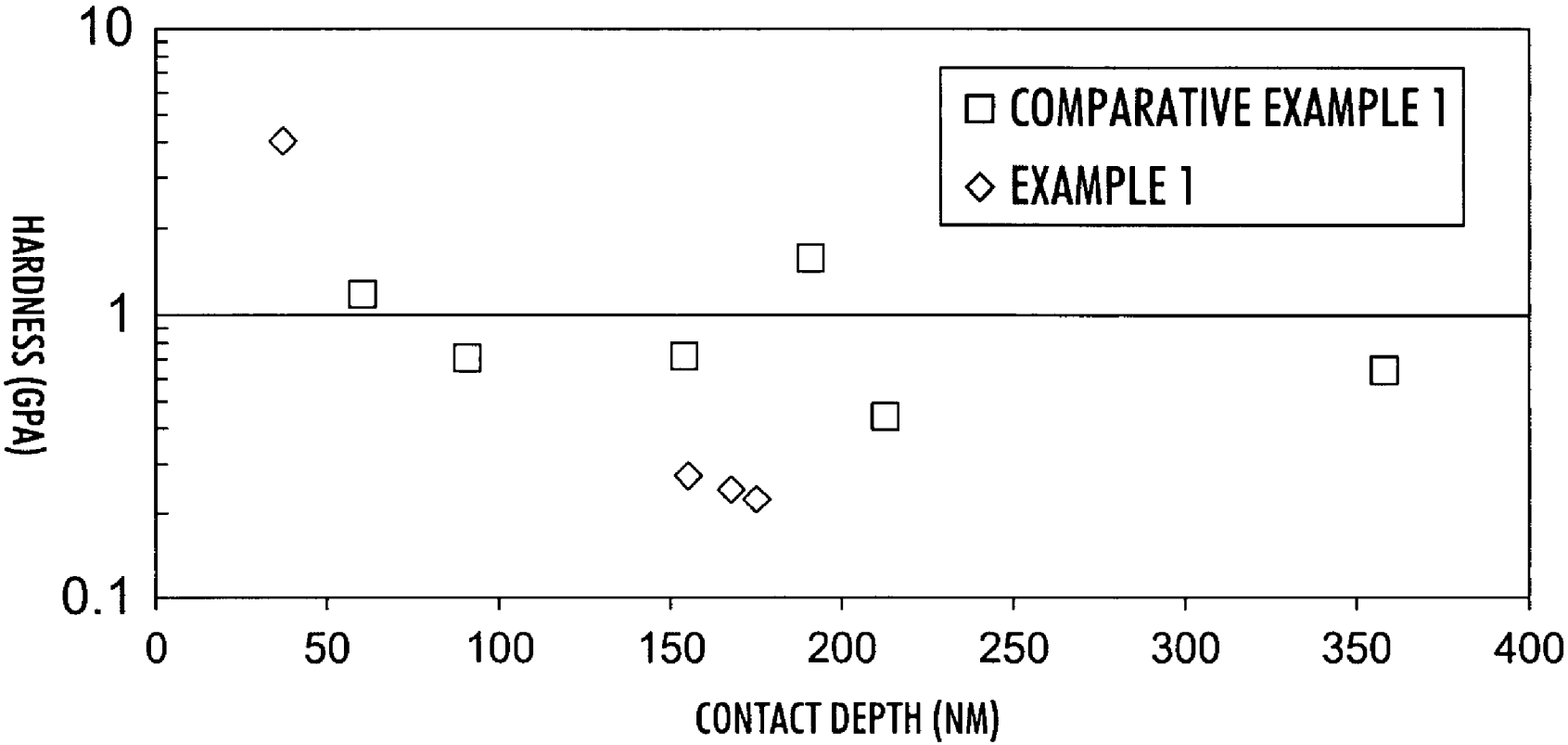
FIG. 4 is a graphical representation of a relationship between contact depth and hardness of an exemplary carrier composition according to embodiments and a conventional carrier composition.

The resilient nature of the coating is characterized in terms of hardness and modulus of the coating, which are shown on FIGS. 3 and 4. FIGS. 3 and 4 demonstrate that carriers coated with thermoplastic resin polymers and/or copolymers containing styrene as part of the coating had lower modulus and hardness. An advantage with such coatings, as described herein, is that inter-particle collision of toner with carrier beads would be less strong because of the resilient-rubbery nature of the coating, due to the lower hardness and modulus. Thus, additives will not be rigidly impacted on the toner particles and will be more freely available for low area coverage development.

Figure 5:
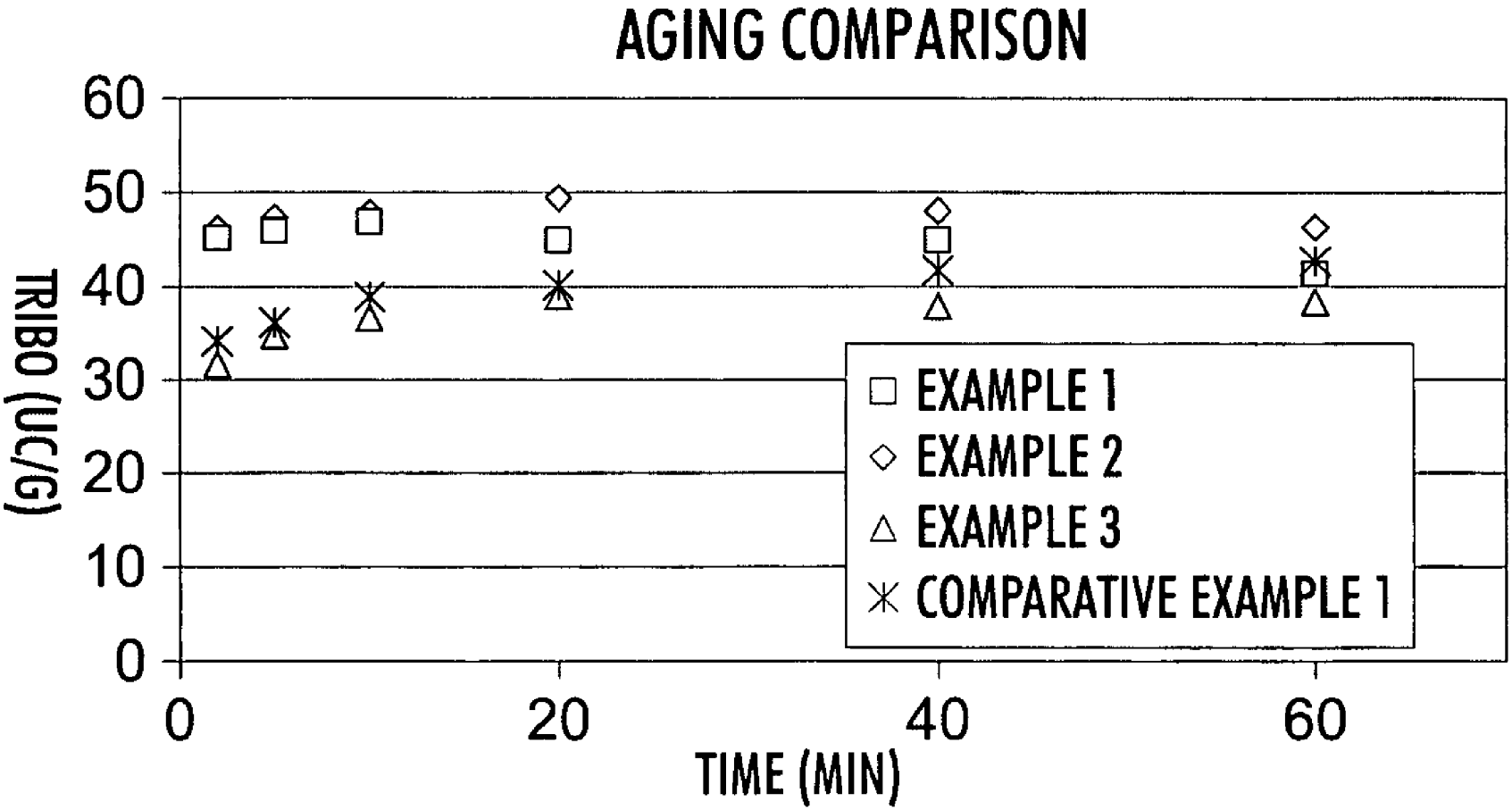
FIG. 5 is a graphical representation of a relationship between time and triboelectric charging of an exemplary carrier composition according to embodiments and a conventional carrier composition.

Bench scale aging of these carriers shows similar results to the control in terms of triboelectric charging. Each carrier composition was aged by mixing 400 g of developer containing the carrier composition in a paint shake mixer. At intervals of 2, 5, 10, 20, 40 and 60 minutes, a sample of the developer was taken. These samples were then analyzed for triboelectric properties. Changes in triboelectric properties with time are the aging characteristics. FIG. 5 shows the results of this testing. The carrier compositions of Examples 1 and 2 are slightly higher than Comparative Example 1, while Example 3 is equivalent to Comparative Example 1.

At the end of the aging cycle, the developer composition was processed to remove the remaining toner, and the remaining carrier was analyzed for impaction. Impaction is an indication of the amount of toner that has been permanently "stuck" or impacted on the carrier surface. As toner impaction increases, the carrier properties degrade, eventually causing development problems within the machine. Table 2 shows that the carrier compositions of Examples 1-3 are much more resilient to toner impaction than the control carrier, Comparative Example 1.

TABLE 2

| | Impaction (mg/g) |
|---|---|
| Comparative Example 1 | 1.0 |
| Example 1 | 0.22 |
| Example 2 | 0.26 |
| Example 3 | 0.42 |

The coated carrier of Example 3 was also analyzed for coating coverage by scanning electron microscopy (SEM). The control carrier, Comparative Example 1, exhibits a coating coverage of 70% on average. The coated carrier of Example 3 was found to have 79% coverage on average, higher than Comparative Example 1. This indicates that the incorporation of thermoplastic resin polymers and copolymers that include styrene does not cause increased exposed core surface that can lead to aging problems; but rather is an improvement over the control in that respect as well.

In summary, the coated carriers including thermoplastic resin polymers and copolymers that include styrene in the coating exhibit stable triboelectric charging during aging, decreased coating hardness, higher coating coverage, and an improved resilience to toner impaction. These factors result in increased carrier and developer life and improved developer aging.

It will be appreciated that various of the above-discussed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of preparing coated carrier particles, comprising:

mixing at least a first polymer component with at least a second polymer component to form a polymer mixture;

mixing the polymer mixture with solid core particles;

coating the polymer mixture onto the solid core particles; and melting the polymer mixture onto the solid core particles;

wherein the first polymer component is chosen from the group consisting of acrylate polymers, methacrylate polymers, acrylate copolymers and methacrylate copolymers, and the second polymer component is chosen from the group consisting of styrene-butadiene-styrene copolymers, styrene-isoprene-styrene copolymers, styrene-ethylene-butylene-styrene copolymers, styrene-ethylene-propylene copolymers, styrene-ethylene-butylene copolymers, hydrogenated and non-hydrogenated polyisoprene copolymers, hydrogenated and non-hydrogenated polyisoprene/butadiene copolymers, hydrogenated and non-hydrogenated polybutadiene copolymers and hydrogenated and non-hydrogenated styrenic block copolymers, and, wherein the polymeric coating comprises about 90 to about 95 percent by weight of the first polymer component, and from about 5 to about 10 percent by weight of the second polymer component, based on the total weight of the polymeric coating.

2. The method according to claim 1, wherein the first polymer component is a powder and the second polymer component is a powder.

3. The method according to claim 1, wherein the mixing at least a first polymer component with at least a second polymer component comprises dry mixing.

4. The method according to claim 1, wherein the mixing the polymer mixture with solid core particles comprises dry mixing.

5. The method according to claim 1, wherein the melting comprises heating to a temperature of, for example, between from about 200° F. to about 650° F.

* * * * *